US005785272A

United States Patent [19]

Slade et al.

[11] Patent Number: 5,785,272

[45] Date of Patent: Jul. 28, 1998

[54] COILER SPOOL WITH BUILT-IN GRIPPER SLOT

[75] Inventors: Philip J. Slade; Roland N. Hequet, both of Pittsburgh, Pa.

[73] Assignee: Kvaerner U.S. Inc., Pittsburgh, Pa.

[21] Appl. No.: 743,839

[22] Filed: Nov. 5, 1996

[51] Int. Cl.[6] ..... B65H 75/28

[52] U.S. Cl. ..... 242/532.5; 242/532.6; 242/586.6; 242/587.2

[58] Field of Search ..... 242/532.5, 532.6, 242/586.6, 587.2, 587.3, 586, 586.1, 586.2, 571, 571.1, 571.2

[56] References Cited

U.S. PATENT DOCUMENTS

| | | | |
|---|---|---|---|
| 341,633 | 5/1886 | Barker | 242/586.6 |
| 385,026 | 6/1888 | Waldron | 242/587.2 |
| 1,838,432 | 12/1931 | Mitchell | 242/586.6 |
| 2,212,309 | 8/1940 | Swanson | 242/586.6 |
| 3,122,337 | 2/1964 | Boron . | |
| 3,223,342 | 12/1965 | Brandon | 242/586.1 |
| 3,315,510 | 4/1967 | Jones . | |
| 3,433,355 | 3/1969 | Smith . | |
| 3,593,938 | 7/1971 | Watt | 242/532.5 |
| 4,455,848 | 6/1984 | Tippins et al. . | |
| 4,485,651 | 12/1984 | Tippins et al. . | |
| 5,009,092 | 4/1991 | Buchegger . | |

*Primary Examiner*—John M. Jillions

*Attorney, Agent, or Firm*—Armstrong, Westerman, Hattori, McLeland & Naughton

[57] ABSTRACT

A coiler spool comprises an elongated, hollow cylinder made of resilient spring steel and having a slot extending longitudinally of the cylinder, and means, such as an expandable mandrel, to radially expand the coiler spool to open the normally closed slot for reception in the open slot of a leading edge of a strip to be coiled. On release of the coiler spool expansion pressure, the coiler spool contracts due to its inherent resiliency and closes the slot, thereby gripping in the slot the leading edge of the strip to be coiled.

12 Claims, 1 Drawing Sheet

COILER SPOOL WITH BUILT-IN GRIPPER SLOT

BACKGROUND OF THE INVENTION

1. Field of the Invention

This invention relates to the coiling of sheets and strip such as steel or other metal, and particularly to an elongated hollow, cylindrical coiler spool made of elastic material and having a longitudinally extending slot for reception and holding of the leading edge of a head end of a sheet or strip to be coiled.

2. Description of the Prior Art

In the coiling of metal sheet and strip (hereinafter called "strip"), it is common practice to use a belt wrapper, for example as shown and described in U.S. Pat. No. 3,315,510, to confine the strip as it is fed to a coiling mandrel to form a uniform coil.

It also is known to provide a cylindrical drum or mandrel on which strip can be coiled and to provide such equipment with a longitudinal slot into which the leading edge of a strip to be coiled can be inserted to hold the head end of the strip while coiling. For example, U.S. Pat. Nos. 4,455,848 and 4,485,651 disclose a rigid slotted, elongated cylindrical drum having a strip entry slot extending along the length of the drum for reception of a leading edge of the strip and which drum has an internal stop extending radially inwardly of the drum at a position opposite the slot and adapted to provide a tortuous path for the strip and providing frictional retaining engagement with the head end of the strip. U.S. Pat. No. 3,122,337 discloses a rigid, cylindrical coiler drum provided with a longitudinal slot for reception of the leading edge of the strip to be coiled and having internal strengthening ribs to reinforce the rigidity of the drum, lugs to guide the advancing edge of the strip, and stops to terminate passage of the strip end inside the drum.

U.S. Pat. No. 5,009,092 discloses a coiling apparatus including a rigid cylindrical coiling mandrel having a slotted opening for reception of the leading edge of a strip to be coiled.

Each such apparatus is expensive and generally has the further drawback of inefficiently holding the leading edge of the strip in the rigid slot during the initial formation of the coil with the first few wraps.

U.S. Pat. No. 3,433,355 relates to the production of rolls of adhesive tape wherein the tape is wound on an expanded core comprising radial segments separated by slots and which, on release of support for the core, collapse to form a unitary core supporting a coil of tape.

SUMMARY OF THE INVENTION

The coiler spool of the invention comprises an elongated hollow cylinder made of an elastic material, such as a suitable spring steel, and having a slot extending along the length of the spool and having a maximum width suitable for reception of the leading edge of a head end of an elongated strip, e.g. of steel or other metal, to be coiled. The elasticity properties of the coiler spool are such that, on expansion of the coiler spool under internal pressure, the slot is opened to receive the leading edge of the strip and, on release of the internal pressure on the spool, is automatically closed, thus tightly gripping the leading edge of the strip during coiling. The coiler spool is provided with an internal expandable mandrel of known type and construction, for example, either full face, stub or other type and either mechanically or hydraulically actuated, and adapted, on actuation, to expand into contact with the interior surface of the coiler spool, forcing open the slot and, on deactuation, to collapse, allowing the coiler spool automatically to contract, by its springlike action, to close the slot and grip the strip for coiling.

DESCRIPTION OF PREFERRED EMBODIMENTS

Figure 1:
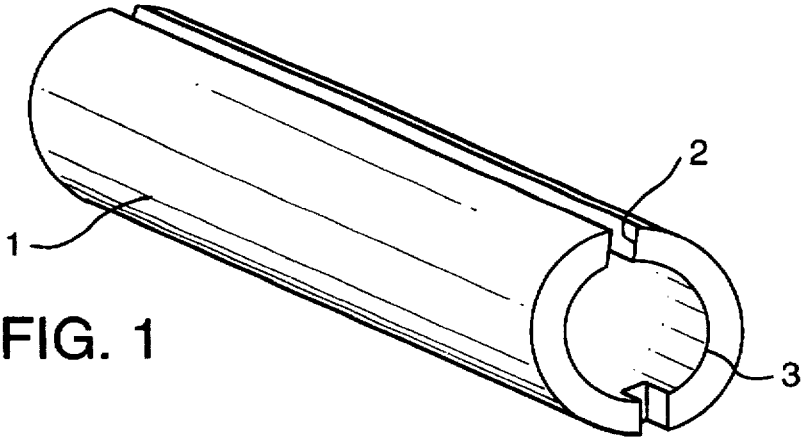
FIG. 1 is an isometric view of the slotted elastic spool of the invention.

Referring to FIG. 1, the coiler spool 1 of the invention comprises an elongated, hollow cylinder provided with a longitudinally extending slot 2 and may have a notch 3 in one end of the wall of the coiler spool. Coiler spool 1 is made of a resilient material, such as a suitable steel, for example, a high carbon, high strength spring steel, so that, on radial expansion of the cylinder, slot 2 is opened and, on release of the expansion pressure, the cylinder contracts to close slot 2. The coiler spool 1 is of sufficient length to accommodate the widest strip to be coiled, and has a suitable thickness, for example 1 inch, to efficiently utilize the resiliency of the spring steel and effectively to support the wraps of a coil wound thereon.

Figure 2:
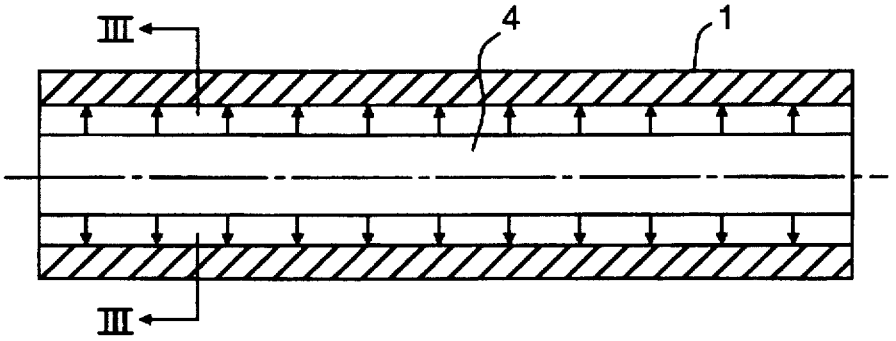
FIG. 2 is a cross-section side elevational view of the coiler spool of FIG. 1.
Figure 3:
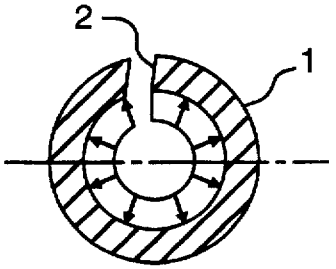
FIG. 3 is a cross-sectional view taken along line III—III of FIG. 2.
Figure 4:
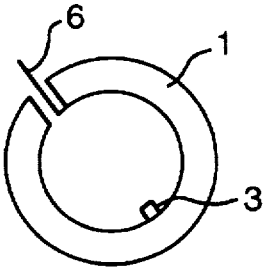
FIG. 4 is an end view of the coiler spool of the invention, showing the open slot receiving a leading edge of a strip to be coiled.
Figure 5:
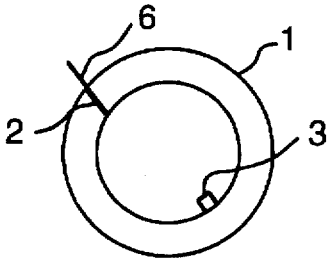
FIG. 5 is a similar view, showing the closed slot gripping a leading edge of the strip.
Figure 6:
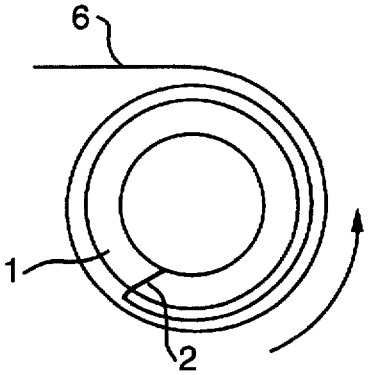
FIG. 6 is an end schematic view of the coiler spool, with closed slot gripping a leading edge of the head end of the partially coiled strip.

As shown in FIGS. 2 and 3, an expandable mandrel 4 may be disposed inside coiler spool 1, the mandrel being fixed in location, and the coiler spool fitted thereover. Mandrel 4 is of conventional, full face, stub or other usual type and construction and, in the case of an hydraulically actuated mandrel, is connected to a source of pressurized fluid (not shown) for expanding the mandrel into contact with the interior wall of the coiler spool 1, as indicated by the arrows in FIGS. 2 and 3, and thereby expanding coiler spool 1 so that the slot 2 is opened for reception therein of a leading edge of a head end of a strip 6, as shown in FIG. 4. On release of pressure, mandrel 4 collapses, allowing coiler spool 1 automatically to contract due to its inherent resiliency, and slot 2 to close, thus gripping the leading edge of the strip 6, as shown in FIG. 5. Thereafter strip 6, so held in position by the gripping action of coiler spool 1, can be coiled, as shown in FIG. 6.

As above described, the coiler spool 1 may be provided with a notch 3 for interlocking with the mandrel 4 so that the mandrel will rotate with the coiler spool 1 during coiling. It it to be understood that notch 3 may be replaced with a protuberance or any other means which will provide the necessary interlocking relationship with the mandrel 4 for the purpose aforesaid.

The improved coiler spool, as herein shown and described, provides an effective and low cost means to facilitate coiling of strip, replacing complicated and expensive coiling devices, such as belt wrappers.

What is claimed is:

1. A coiler spool comprising an elongated hollow resilient cylinder provided with a slot extending longitudinally of the cylinder, and an expandable mandrel disposed inside the cylinder such that, on expansion of the mandrel, the mandrel exerts radially outwardly directed pressure on an interior surface of the cylinder and the cylinder expands and the slot is opened for reception of a leading edge of a strip to be coiled and, on collapse of the mandrel, the cylinder contracts and closes the slot, thus gripping the leading edge of the strip for coiling.

2. A coiler spool according to claim 1, wherein the mandrel is adapted, on actuation of a mandrel expansion means, to contact an interior surface of the cylinder to expand the cylinder sufficiently to open the slot for reception of the leading edge of the strip and, on releasing of the mandrel expansion means, to allow the cylinder to contract and close the slot thus gripping the leading edge of the strip for coiling.

3. A coiler spool according to claim 2, wherein the mandrel is a pressurizable mandrel and is expandable by fluid pressure and collapsible by release of the fluid pressure.

4. A coiler spool according to claim 1, wherein the cylinder further comprises means thereon for contacting the mandrel and facilitating rotation of the mandrel with the coiler spool during coiling.

5. A coiler spool according to any one of claims 1 and 2–3 wherein the cylinder is made of a spring steel.

6. A coiler spool according to any one of claims 1 and 2–5, further comprising means to lock together the cylinder and the mandrel such that the cylinder and mandrel can rotate together.

7. A coiler spool according to any one of claims 1 and 2–5, further comprising a notch in the cylinder cooperating with an inter-locking protuberance on the mandrel so that the cylinder and the mandrel rotate together.

8. A coiler spool according to any one of claims 1 and 2–5 further comprising an interlocking protuberance on the cylinder cooperating with a notch on the mandrel, so that the cylinder and the mandrel rotate together.

9. A method of coiling strip comprising providing a coiler spool comprising an elongated, hollow, resilient cylinder having a slot extending longitudinally of the cylinder and normally closed in absence of a cylinder expanding pressure and an expandable mandrel disposed inside the cylinder, expanding the mandrel and thereby applying a radially outwardly directed pressure against an interior surface of the cylinder sufficiently great to open the slot for reception of a leading edge of a strip to be coiled, introducing into the open slot the leading edge of the strip to be coiled, relieving the cylinder expanding pressure by collapsing the mandrel thereby allowing the cylinder to contract due to its inherent resiliency and to grip the leading edge of the strip, and coiling the strip.

10. A method according to claim 9, comprising expanding the mandrel with use of fluid pressure.

11. A coiler spool according to any one of claims 9 and 10 comprising making the cylinder of spring steel.

12. A method according to any one of claims 9 and 10, further comprising locking together the cylinder and mandrel and rotating them together.

* * * * *